United States Patent [19]

Soloway et al.

[11] Patent Number: 4,892,981

[45] Date of Patent: Jan. 9, 1990

[54] SNAP-IN MODULAR KEYPAD APPARATUS

[76] Inventors: Richard Soloway, 2 Richard Rd., Lido Beach, N.Y. 11566; Richard Farrell, 84 Claire Ct., West Babylon, N.Y. 11704

[21] Appl. No.: 248,824

[22] Filed: Sep. 26, 1988

[51] Int. Cl.[4] ..... H01H 13/70

[52] U.S. Cl. ..... 200/5 A; 200/292; 200/294

[58] Field of Search ..... 200/5 R, 5 A, 512, 513, 200/516, 517, 275, 314, 292, 294

[56] References Cited

U.S. PATENT DOCUMENTS

| | | | |
|---|---|---|---|
| 4,243,846 | 1/1981 | Lenaerts et al. | 200/5 A X |
| 4,409,450 | 10/1983 | Blades | 200/5 A X |
| 4,580,018 | 4/1986 | Yoshihara | 200/5 A X |
| 4,636,593 | 1/1987 | Novak et al. | 200/5 A |
| 4,700,025 | 10/1987 | Hatayuma | 200/314 X |

*Primary Examiner*—J. R. Scott

*Attorney, Agent, or Firm*—Arthur L. Plevy

[57] ABSTRACT

A modular snap-in keypad apparatus includes a planar frame member having a plurality of button accommodating apertures and a plurality of mounting posts extending therefrom. An elastomeric key button assembly has a planar surface containing a plurality of apertures which are positioned to receive each post. The button assembly comprises a plurality of raised elastomeric button structures which extend through an associated button accommodating aperture when said posts of said frame assembly accommodates the apertures in the button assembly. A planar switch assembly has a plurality of apertures which are congruently positioned with respect to the posts to enable the contact assembly to be positioned with respect to each button so that a conductive area of the button contacts the contact assembly when the button is depressed. The contact assembly is fabricated on a Mylar sheet and has a contact area which consists of an outer partial circular contact having inwardly disposed triangular projections and an inner T-shaped contact. When a button is depressed the inner T-shaped contact contacts the outer circular contact by means of the conductive area of the button. A planar back plate is secured to the frame assembly by means of apertures therein. The back plate supports and further enables a user to tactically respond to switch depression.

19 Claims, 3 Drawing Sheets

FIG. 1
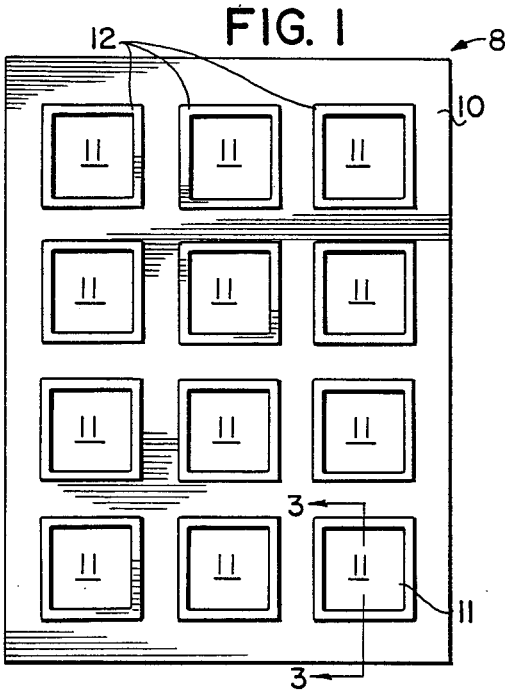
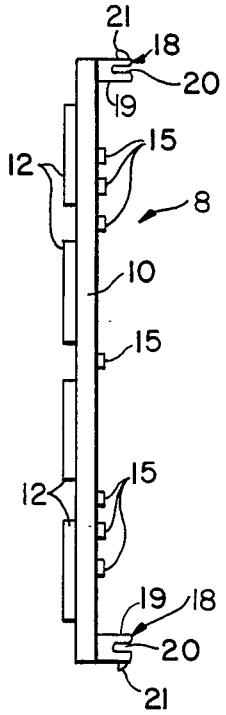
FIG. 2
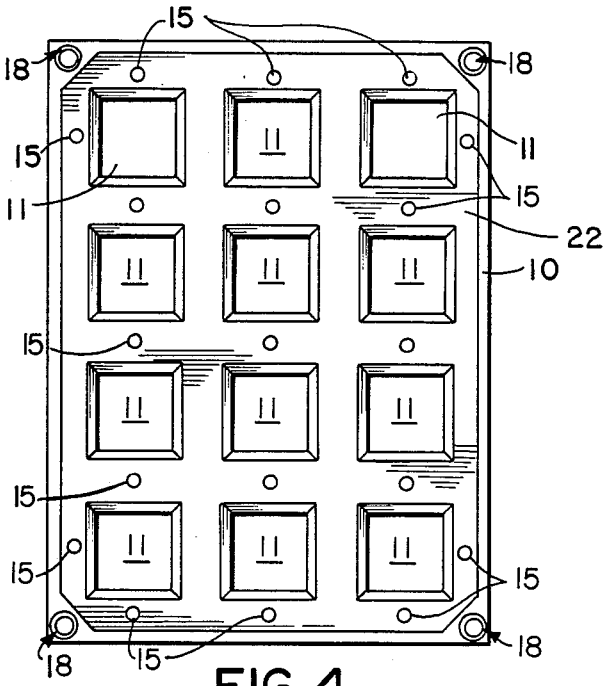
FIG. 4
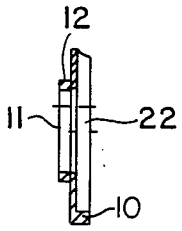
FIG. 3

SNAP-IN MODULAR KEYPAD APPARATUS

BACKGROUND OF THE INVENTION

This invention relates to a keypad apparatus and more particularly to a keypad apparatus which employs snap-in modular planar component assemblies.

The prior art is replete with numerous keypad or keyboard devices which are used for example in conjunction with telephone subsets to implement dialing. The typical telephone subset, for example, contains an array of 12 buttons which formulate a keypad enabling a user to dial in various numbers and to utilize two special keys for implementing various other requests. Such keypads have been widely employed in the intrusion detection field whereby the keypads are utilized with control panels in order to allow a user of an intrusion system to implement various system functions via the keypad. As one can ascertain, keypads are widely used in numerous other applications such as access control systems, automatic bank teller systems, calculators, and so on.

Thus, the use of keypads is relatively extensive and they are widely employed in a host of different applications. One will readily understand that the prior art is replete with numerous keypad configurations and structures which implement keypads which utilize various switching techniques and so on. The prior art is extensive and there exists various different types of keypads for use in all of the above applications.

Based on such use, it is, of course, apparent that there is a need for a keypad which is extremely economical to manufacture and extremely simple to construct while providing high reliability. A major problem that exists in many keypads is that in order to achieve reliable operation, one must depress a given button or key associated with the keypad relatively at the center to assure reliable operation. In this manner, when depressing the button at a central location, one can be sure that the proper signal is forwarded to the decoding circuitry. If a key is struck at a side or off center, oftentimes contact is not made and therefore the user does not really register the particular digit. This can create many problems in that depression of a key or button off center will not close the switch. As one can understand, it is important that a user when attempting to access a button associated with the keypad can operate the same reliably and even if the operating force is applied off center.

It is, therefore, an object of the present invention to provide a reliable operating keypad apparatus which is economical and simple to manufacture.

It is yet a further object of the present invention to provide a modular keypad employing a unique contact design which allows consistent switching when a key is depressed at its edge rather than at dead center.

It is a further object of the present invention to provide a modular keypad apparatus which employs snap-in components while enabling one to achieve reliability in an economical configuration.

The keypad to be described utilizes modular snap-in components which are easily inserted into posts associated with a frame member.

BRIEF DESCRIPTION OF THE PREFERRED EMBODIMENT

A keypad apparatus, comprising a frame member of a planar configuration having a plurality of key button accommodating apertures located on said planar surface and extending from the front to the back thereof, with the back surface of said frame member having a plurality of extending post members, an elastomeric key button assembly having a planar surface containing a plurality of apertures positioned congruently with said posts to enable each post to accommodate a corresponding aperture, said button assembly comprising a plurality of extending elastomeric button structures, each extending through an associated accommodating aperture of said frame when said posts accommodate said key button assembly and each button having a conductive bottom member located on the bottom of said button structure with each button structure adapted to be moved when accessed to cause said conductive bottom member to move, a contact assembly fabricated on a thin planar member and having a plurality of apertures positioned congruently with said posts to enable each post to accommodate a corresponding aperture to position said contact assembly in an operative position with respect to said button assembly, said contact assembly including one contact area for each button structure, which contact area comprises an outer partial circular contact having extending triangular sections and an inner T-shaped contact surrounded by said outer contact, with each contact area underlying an associated conductive bottom member to enable said outer contact to contact said T-shaped contact upon depression of an associated button, and a planar back plate member having a plurality of apertures positioned congruently with said posts to enable each post to accommodate a corresponding aperture, with said back plate serving as a stop to enable an operator of a button to tactically feel said button operation.

BRIEF DESCRIPTION OF THE FIGURES

FIG. 1 is a front plan view of a frame assembly associated with the modular keypad apparatus.

FIG. 2 is a side view of the frame assembly of FIG. 1.

FIG. 3 is a cross sectional view taken through line 3—3 of FIG. 1.

FIG. 4 is a back plan view of the frame assembly of FIG. 1.

DETAILED DESCRIPTION OF THE FIGURES

Figure 5:
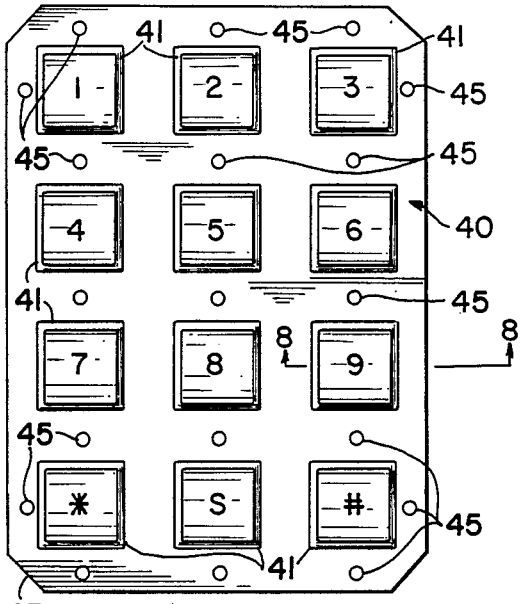
FIG. 5 is a front plan view of an elastomeric keypad button assembly.

Referring to FIG. 1, there is shown a keypad 8 having a frame member 10. The frame member 10 is shown in the front plan view and is fabricated from a suitable moldable plastic. As shown in FIG. 1, the frame member 10 contains 12 square apertures 11 where each aperture is surrounded by an extending flange 12 which appears as a picture frame. Each aperture, as will be explained, will receive an associated button or key.

The frame member 10 has four rows of apertures 11 each containing three apertures 11 in a row for a 4×3 assembly. The plastic material is A.B.S. such as sold by Borg-Warner under the trademark CYCOLAC or any other moldable plastic material.

As indicated above, FIG. 1 shows the front plan view of the frame member 10 depicting the twelve apertures 11. By way of example the frame member 10 is approximately 3 inches in height and 2 ¼ inches in width and is a rectangular planar configuration. Each aperture 11 is 0.4 inches square and is surrounded by the extending flange 12. It is noted that the shape of the aperture 11 can vary and any suitable geometric shape will suffice.

FIG. 2 shows a side view of the frame member 10 depicted in FIG. 1. As one can see from FIG. 2 the extending flanges 12 extend from the surface of the frame member 10. The frame member 10 has a back surface which contains a plurality of mounting posts 15 (only seven being visible) projecting therefrom. These posts 15 as will be further explained, accommodate various other components associated with the keypad 8.

As shown in FIG. 2 and as will be further described, there are four securing posts 18 (only two being visible) which are located on the back surface and at a suitable corner of the frame member 10. Each securing post 18 has a cylindrical body 19, a central channel 20 and has a tapered locking located at the end of the body 19. As can be seen in FIG. 2, the central channel 20 extends partially through the body 19. The functions of extending securing posts 18 are to enable the keypad 8 to be mounted onto a mounting panel (not shown) having four mounting panel apertures with each of the posts 18 pushed into a suitable mounting panel aperture. The mounting panel apertures formed on the surface of the mounting panel secure the frame member 10 to the mounting panel. The center channel 20 of each securing post 18 enables the body 19 to slightly compress with the locking flange 21 acting to firmly secure the securing post 18 within the mounting panel aperture. In this manner, the entire frame member 10 can be mounted on a suitable planar surface having four accommodating apertures and is pushed into position such that it is held in place.

FIG. 3 shows a cross sectional view through a typical aperture 11 taken through line 3—3 of FIG. 1. As can be seen, the back of the frame member 10 has an internal hollow 22. The entire thickness of the frame member 10 is typically 0.1 inch with the extending flange 12 being 0.062 inches. The internal hollow 22 as indicated is extremely shallow being 0.069 inches and, as will be explained, accommodates other modules associated with the keypad.

Referring to FIG. 4, there is shown a back plan view of the frame member 10. As seen in FIG. 4, the securing posts 18 are four in number. Each extending flange 12 is chamfered at a 45° slope which is also seen in FIG. 3. Seen clearly in FIG. 4 are the mounting posts 15. As one can ascertain, there are 19 mounting posts associated with the frame member 10 and located on the back surface thereof.

Referring to FIG. 4, there is shown the aperture 11 having the mounting post 15 at the top side relatively in line with the center line of the aperture 11 with a corresponding mounting post 15 at the bottom side relatively in line with the center line of aperture 11. As can be seen, each aperture 11 is surrounded by two such posts. As further seen, there are , in addition to the fifteen aforementioned mounting posts 15, four mounting posts 15 which delineate the top and bottom rows of apertures 11 and which are positioned along the center line of the respective aperture 11. Hence, as one can ascertain, there are nineteen mounting posts 15 all of which are integrally formed and extend from the back surface of the frame member 10.

The securing posts 18, are all of the same configuration, as for example, shown in FIG. 2 and are longer than the mounting posts 15. The securing posts 18 extend further than mounting posts 15 and as indicated are used to secure the entire switch assembly 60 into suitable apertures (shown in FIG. 9) associated with a typical mounting surface.

Referring to FIG. 5, there is shown a front view of a button assembly 40. The button assembly 40 is fabricated from an elastomeric material such as a rubber material or a silicone material. The entire button assembly 40 as shown in FIG. 5 is molded and integrally formed. The button assembly 40 has a planar member 43 shaped to fit within the internal hollow 22 of the frame member 10 and held in place by the mounting posts 15 of the frame member 10. There are twelve buttons 41, each of which is characterized by a raised section which extends from the planar member 43 of the button assembly 40 and each of which is fabricated from an elastomeric material and integrally formed with the planar member 43. The planar member 43 of the button assembly 40 has a plurality of apertures 45 which are of smaller diameter than the body 19 of the securing posts 15 associated with the frame member 10.

As one can ascertain from FIG. 5, there is an aperture 45 located on the planar member 43 which corresponds to the location of each mounting post 15. These apertures (19 in number) enable the entire button assembly 40 to be secured to the frame assembly by means of the mounting posts 15. Thus when the button assembly 40 is mounted on the frame member 10, the buttons 41 extend through the apertures 11 of the frame member 10 and can be accessed at the front surface, the internal hollow 22 receives the planar member 43, and the apertures 43 receive the mounting posts 15. Each button 41 of the button assembly 40 has a suitable number or indicia impressed thereon and is typical of a keypad format.

Figure 6:
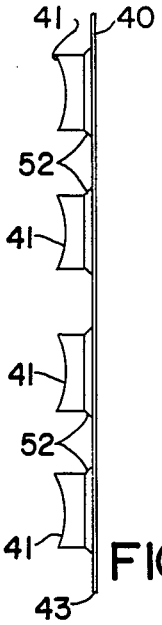
FIG. 6 is a side view of the assembly of FIG. 5.

As seen in FIG. 6, there is shown a side view of the button assembly 40. Each key button 41 has a rounded depressed surface which is 1.5 inches in diameter to enable comfortable operation position as to accommodate finger operation.

Figure 7:
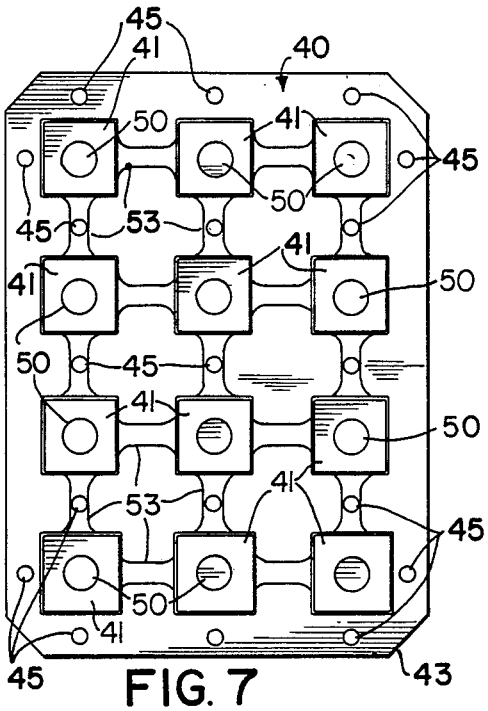
FIG. 7 is a rear view of the assembly of FIG. 5.

As seen in FIG. 7, a conductive disk 50 is fabricated from a conductive rubber material or other conductive material. Many such materials are known in the art and such conductive materials may constitute a suitable elastomeric material which has impregnated therein a conducting material such as metal particles. The conductive disk 50 can be a conductive carbon disk. Each of these conductive disks 30 is secured to the bottom surface of the button 41 which is shown in greater detail in FIG. 8. The conductive disk 50 may be glued or otherwise secured at the bottom surface of the button 41 as shown.

Figure 8:
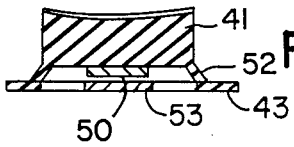
FIG. 8 is a cross sectional view taken through line 8—8 of FIG. 5.

As seen in FIG. 8, the button 41 has the conductive disk 50 located on the bottom surface. The button 41 is integrally formed, as indicated by a molding technique, with a sloping peripheral channel 52 which operates in a spring manner to enable the button 41 to rebound once a force is removed from the arcuate top surface of the button 41. This is a relatively conventional configuration. As shown in FIG. 7, each of the various buttons 41 are associated with an intermediate channel 53 which is of a thinner dimension and typically 0.01 inches as compared to the 0.032 inch thickness of the bottom planar surface of member 40. These intermediate channels 53 located as shown in FIG. 7 enable accurate switch depression by serving to isolate the buttons 41 from each other.

As seen in FIG. 8 and as clearly understood, each of the buttons 41 is integrally formed on the planar member 43 and operates as a push button. Hence, when a force is applied to the top surface of button 41, the conductive disk 50 is moved downwardly due to the compression of the peripheral channel 52. As will be explained, this movement enables the conductive disk 50 to contact the switch assembly 60 (see FIG. 9) to enable switch activation. This will be more clearly explained. It is also understood that the apertures 45 as located on the planar member 43 of the button assembly 40 are nineteen in number and are adapted to coact with the mounting posts 15 associated with the frame member 10 as a result of having smaller diameters than the bodies 19 of the mounting posts 15. Hence as one can clearly understand, the entire button assembly 40 as shown in FIGS. 5, 6, and 7 is secured to the frame member 10 by the apertures 45 which coact with the corresponding mounting posts 15 and enable the switch button 41 to protrude through the apertures 11.

Figure 9:
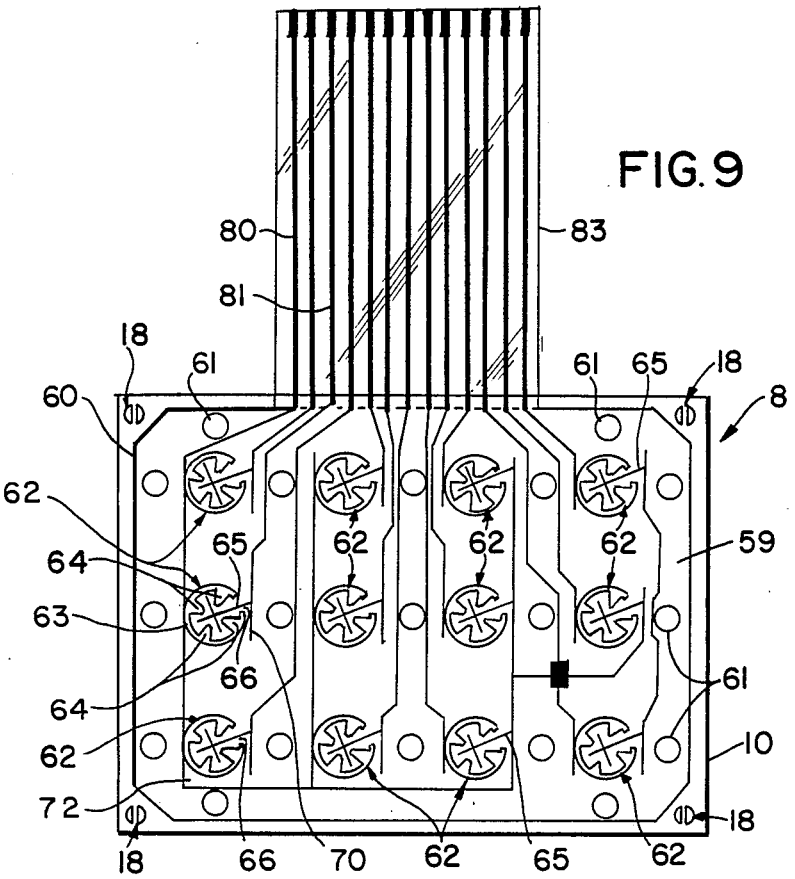
FIG. 9 is a front plan view of a contact assembly employed with the keypad apparatus.

Referring to FIG. 9, there is shown a switch assembly 60 which is associated with the keypad 8. As seen in FIG. 9, the entire contact assembly 60 is fabricated on a single thin sheet 59 of Mylar. The Mylar sheet 59 has impressed therein by photographic means a plurality of contact areas 62. Each contact area 62 is associated with one of the buttons 41 as shown in FIG. 5. The contact areas 62 are impressed on the Mylar sheet 59 by means of thin silver conductive elements. Each of the contact area 62 is associated with an outer peripheral ring 63 having four equally spaced triangular projections 64 which extend in towards the center of the outer peripheral ring 63. As seen, the outer peripheral ring 63 is a partial circle having an opening 66. The outer peripheral ring 63 forms one switch contact. The center of the outer peripheral ring 63 is characterized by having a T-shaped or cross-shaped conducting section 65 which is insulated by means of the Mylar from the outer peripheral ring 63 and triangular tabs 64. As can be seen, the lower branch of the T-shaped conducting section 65 passes through the opening 66 of the outer peripheral ring 63. Each T-shaped conducting section 65 is the coupled to a first conductive line area 70 while each outer peripheral ring is connected to a second conductive line area 72.

As shown in FIG. 9, nineteen congruent apertures 61 are positioned on the Mylar sheet 59 to receive the nineteen mounting posts 15 when the Mylar sheet 59 is inserted into the internal hollow 22 of the frame member 10. Thus, the congruent apertures 61 function to secure the Mylar sheet 59 to the frame member 10. The congruent apertures 61 also function to align the contact areas 62 on the Mylar sheet 59 with the conductive disks 50 on the buttons 41. In this manner, the frame member 10 and switch assembly 60 snap together.

As previously described, each button 41 has a conductive disk 50 corresponding to a contact area 62. As one can ascertain from the construction shown in FIG. 9, when a button 41 is depressed, the conductive disk 50 associated with the button 41 impinges and touches both the T-shaped conducting section 65 and a triangular projection 64. In this manner, second conductive line 72 is connected to the first conductive line 70.

AS shown in FIG. 9, second conductive line 72 is directed to an output tab 83 by means of first conductor 80 while first conductive line 70 is associated with the same conductor tab 83 by means of second conductor line 81. As seen, each of the contact areas 62 as shown in FIG. 9 is associated with a suitable conductor 80 and 81 on the output tab 83. The contact areas 62 and output tab 83, including all connections, as indicated, are fabricated on a single Mylar sheet 59 which is formed by means of a mask employing photographic techniques and having silver conductive lines. The side of the contact area 62 which faces the conductive disk 50 is further coated with a conductive carbon layer to prevent silver migration as is known in the art.

As one can see, based on the configuration of the contact area 62 associated with each button 41, the extending triangular projections 64 in conjunction with the T-shaped conducting section 65 operates in such a manner that when a suitable button 41 is depressed, the conductive disk 50 will always contact at least one of the triangular projections 64 while also contacting the T-shaped conducting section 65. Thus, the outer peripheral ring 63 has the equally spaced triangular projections 64 which extend towards the center thereof. Located between the triangular projections 64 is the upper branch of the T-shaped conducting section 65 as shown in FIG. 9. The lower branch of the T-shaped conducting section 65 is located between the triangular projections 64 as well and extends through the opening 66 to contact the terminal first conductive line 70. The conductive disk 50 is of a smaller diameter than the outer peripheral ring 63 and is positioned centrally or coaxially therewith to assure that contact will be made through the conductive disk 50 to connect the T-shaped conducting section 65 to the outer peripheral ring 63. In this manner one will always operate the keypad 8 even though the button 41 is not pressed at the dead center. Hence, the button 41 can be pressed at the side or anywhere else on the surface, and as long as the force imparted is sufficient, the button 41 will make reliable contact.

Figure 10:
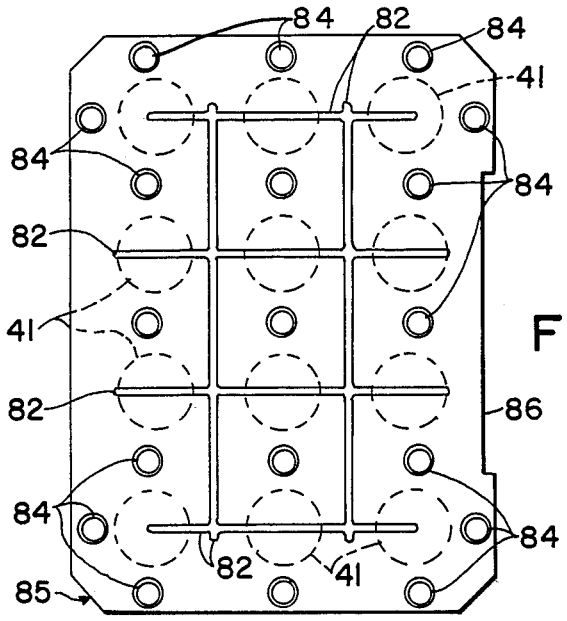
FIG. 10 is a front plan view of a back plate assembly utilized with the keypad apparatus.

Referring to FIG. 10, there is shown a keypad back plate 85. The keypad back plate 80 has a plurality of back plate apertures 84 which are congruently formed to receive the nineteen mounting posts 15 associated with the frame member 10 of FIG. 1.

Figure 11:
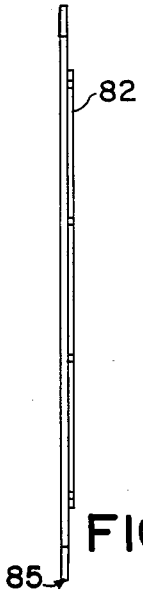
FIG. 11 is a side view of the back plate apparatus of FIG. 10.

As seen in FIGS. 10 and 11, the back plate 85 is associated with a series of raised peripheral flanges 82 formulated in a grid configuration. In FIG. 10 there is shown dashed circles which are indicative of the contact areas 62 of FIG. 9. The raised peripheral flanges 82 are structured to cross each contact area 62 at the center. The back plate 85 serves as a definite stop mechanism to enable a user when contacting a button 41 to "feel" the operation due to the fact that the back plate 85 will be impinged upon by the depression of the button 41. In this manner, the entire key pad 8 provides a reliable operate/non operate indication when button 41 is accessed due the back plate 85. The back plate 85 is fabricated from a clear or transparent plastic material which may, for example, be a clear acrylic plastic and has back plate apertures 84, as indicated, to accommodate the mounting posts 15 on the frame member 10. The clear nature of the back plate 85 enables the button assembly 40 to be illuminated by means of various lamps (not shown) which are positioned relatively central to the various button 41 locations.

Such lamps are known in the art, and for example when a button 41 is depressed, a suitable contact closure (not shown) will enable the activation of the lamp to illuminate the depressed button 41 thereby giving the operator a further indication of button 41 operation. In a similar manner, the entire button assembly 40 can be illuminated by means of a separate lamp (not shown) to enable operation of the keypad 8 in dark environments. The elastomeric button assembly 40 can be fabricated from a translucent elastomeric material to allow light to pass through.

As seen in FIG. 10, the back plate 85 has a side aperture 86 which is of a sufficient width to accommodate output tab 83 associated with the switch assembly 60 of FIG. 9. As one can understand from the above, the keypad 8 consists of four basic components or four modular elements—namely, a frame member 10 as shown in FIG. 1 which has the suitable button accommodating square apertures 11 and has mounting posts 15 which accommodate the second component which is the elastomeric button assembly 40 of FIG. 5. The button assembly 40 is held in place by inserting the apertures 45 of the button assembly 40 over the mounting posts 15.

The next or third modular element is the Mylar switch assembly 60 shown in FIG. 9 which then is placed over the mounting posts 15 after insertion of the button assembly 40. Then the back plate 85, the fourth modular element, is then placed over the contact assembly by means of the back plate apertures 84 which are also accommodated by means of the mounting posts 15 which extend from the frame member 10. When the keypad 8 is thus assembled, the mounting posts 15 can be pressed or expanded at the top to firmly hold the modular elements within the frame member 10.

Hence, as one can ascertain from the above description, the entire keypad 8 consists essentially of the planar-like members which are snapped onto and integrally associated with the frame member 10. In this manner, an entire 12-button keypad 8 can be assembled rapidly after each of the individual components have been molded. The mounting posts 15 accommodate the associated apertures 45, 61 and 84 in each of the modular assemblies 40, 60 and 85, respectively and allows a substantial savings in assembly time. The entire keypad 8 has an extremely low profile which permits compact packaging.

The clear back plate 85 as shown in FIG. 10 allows back lighting when the button assembly 40 employs translucent buttons 41. The unique design of the contact areas 62 as shown in FIG. 9 allows consistant switching even when an elastomeric button 41 is pressed at the edge rather than at dead center. Hence, the above keypad 8 enables rapid assembly time while assuring reliable operation based on the above-noted construction.

Although the present invention has been described in connection with a highly specific exemplary embodiment thereof, it will be understood that many variations and modifications can be made by those of ordinary skill in the art. Therefore, it is manifestly intended that this invention be only limited by the claims and the equivalents thereof.

We claim:

1. A keypad apparatus comprising:

a planar frame member having a front surface and a back surface, and including a plurality of button accommodating apertures located on said planar member extending from the front surface to the back surface, and a plurality of mounting post members extending outwardly from said back surface thereof;

a button assembly including a planar elastomeric member having a front surface and a back surface, and a plurality of elastomeric buttons dimensioned to be received by said button accommodating apertures and formed integrally with said elastomeric member extending outwardly from said front surface, said elastomeric member having a plurality of first apertures extending from the front surface to the back surface and being positioned thereon to receive said mounting post members such that each of said buttons extends through an associated button accommodating aperture of said frame, said button assembly being mounted to said frame such that said buttons are depressable, each button having a conductive bottom member located on the bottom thereof;

a switch assembly including a thin planar member fabricated from Mylar having a front surface and a back surface, and a plurality of contact areas located on the front surface of the thin planar member, one contact area corresponding to each button, said contact area having an outer partial circular contact disrupted by an opening and electrically connected to at least four equally-spaced, inwardly disposed triangular sections, and an inner T-shaped contact surrounded by said outer contact, said T-shaped contact having an upper branch and a lower branch, said upper branch being positioned between said triangular sections and said lower branch extending through said opening, said inner T-shaped contact being electrically insulated from said outer partial circular contact, said thin planar member having a plurality of second apertures extending from the front surface to the back surface and being positioned to receive said mounting post members such that said contact areas oppose said corresponding buttons, said switch assembly being mounted on said button assembly such that said corresponding conductive bottom member electrically connects said outer contact to said T-shaped inner contact upon depression of an associated button; and a planar back plate member having a front surface and a back surface and including a plurality of third apertures positioned to receive said mounting post members, the front surface of said back plate being mounted on top of said switch assembly with said mounting post members extending through said third apertures, said mounting post members having their respective ends deformed to form a fixed, secured sandwich-like assembly, said back plate serving as a stop to enable an operator of a button to tactically feel said button operation.

2. The key pad apparatus according to claim 1, wherein each of said button accommodating apertures is surrounded by a flange extending outwardly from said front surface of said frame.

3. The key pad apparatus according to claim 2, wherein said each button accommodating aperture is square.

4. The key pad apparatus according to claim 1, adapted to be secured to a mounting panel having at least four mounting apertures, further including four securing posts located at respective corners of said frame member extending outwardly from said back surface at a distance greater than said mounting post members, said securing post members having means located at their respective ends to enable each said securing post to be inserted into a mounting aperture to hold said frame member to the mounting panel.

5. The key pad apparatus according to claim 1, wherein each of said buttons has a top depressed surface for accommodating finger operation, the button being connected to the front surface of said planar elastomeric member by a surrounding peripheral section to enable snap-action operation.

6. The keypad apparatus according to claim 5, wherein each conductive contact area is fabricated from a silver conductive pattern covered with a conductive carbon as facing said conductive bottom member.

7. The keypad apparatus according to claim 6, further including an output tab integrally formed with said switch assembly having conductors electrically connected to said inner and outer contacts, respectively, of each contact area.

8. The key pad apparatus according to claim 1, wherein said button assembly is fabricated from silicone rubber.

9. The apparatus according to claim 1, wherein said conductive bottom member is a circular disk.

10. The apparatus according to claim 1, wherein said back plate member is fabricated from a clear plastic.

11. The key pad apparatus according to claim 1, wherein said back plate member includes raised peripheral flanges formed in a grid-like structure located on the back surface of said back plate functioning to provide rigidity to said back plate.

12. The apparatus according to claim 1, wherein said frame assembly is fabricated from a rigid plastic material.

13. The key pad apparatus according to claim 1, wherein said plurality of button accommodating apertures are twelve button accommodating apertures arranged in four rows of three columns.

14. The key pad apparatus according to claim 13, wherein said frame member has nineteen mounting post members, fifteen of said nineteen mounting post members being arranged in five rows of three columns with said five rows surrounding said four rows of button accommodating apertures, and four mounting posts being positioned with the first and last button accommodating apertures in the first and last rows, respectively, having another mounting post member at a side.

15. The keypad apparatus according to claim 1, wherein said first and second apertures on said button assembly and said switch assembly, respectively, are congruently positioned and dimensioned such that they are force-fitted over said mounting post members.

16. The keypad apparatus according to claim 1, wherein said elastomeric key button assembly is fabricated from a translucent elastomeric material.

17. The keypad apparatus according to claim 1, wherein said frame member is a rectangular planar member, having square shaped key button accommodating apertures.

18. The keypad apparatus according to claim 1, wherein said bottom conductive member is glued to said bottom of said button structure.

19. The apparatus according to claim 1, wherein said conductive bottom member is circular and of a smaller diameter than said outer circular contact.

* * * * *